US009796194B2

(12) United States Patent
Skorzik et al.

(10) Patent No.: US 9,796,194 B2
(45) Date of Patent: Oct. 24, 2017

(54) ENGINEERED WOOD BOARD PRODUCTION INSTALLATION AND METHOD FOR PRODUCING AN ENGINEERED WOOD BOARD

(71) Applicant: FLOORING TECHNOLOGIES LTD., Pieta (MT)

(72) Inventors: Timo Skorzik, Gotha (DE); Thomas Habetha, Prenzlau (DE)

(73) Assignee: FLOORING TECHNOLOGIES LTD, Kalkara (MT)

( * ) Notice: Subject to any disclaimer, the term of this patent is extended or adjusted under 35 U.S.C. 154(b) by 0 days.

(21) Appl. No.: 15/122,508

(22) PCT Filed: Jan. 22, 2015

(86) PCT No.: PCT/EP2015/000115
§ 371 (c)(1),
(2) Date: Aug. 30, 2016

(87) PCT Pub. No.: WO2015/149894
PCT Pub. Date: Oct. 8, 2015

(65) Prior Publication Data

US 2017/0087892 A1 Mar. 30, 2017

(30) Foreign Application Priority Data

Apr. 2, 2014 (EP) ..... 14163278

(51) Int. Cl.

| | |
|---|---|
| ***B41J 13/00*** | (2006.01) |
| ***B41J 3/407*** | (2006.01) |
| ***B41J 11/00*** | (2006.01) |
| ***B27N 3/04*** | (2006.01) |
| ***B27N 7/00*** | (2006.01) |
| *B44C 5/04* | (2006.01) |

(52) U.S. Cl.
CPC ..... *B41J 13/0009* (2013.01); *B27N 3/04* (2013.01); *B27N 7/005* (2013.01); *B41J 3/407* (2013.01); *B41J 11/002* (2013.01); *B44C 5/04* (2013.01)

(58) Field of Classification Search
CPC .. B27N 3/04; B27N 7/005; B41J 3/407; B41J 11/002; B41J 13/009
See application file for complete search history.

(56) References Cited

U.S. PATENT DOCUMENTS

| | | | |
|---|---|---|---|
| 6,022,104 | A | 2/2000 | Lin et al. |
| 2007/0193174 | A1 | 8/2007 | Vogel et al. |

(Continued)

FOREIGN PATENT DOCUMENTS

| | | |
|---|---|---|
| DE | 102008008292 | 8/2009 |
| EP | 0875382 | 11/1998 |

(Continued)

*Primary Examiner* — Lamson Nguyen
(74) *Attorney, Agent, or Firm* — Andrew M. Calderon; Roberts Mlotkowski Safran Cole & Calderon, P.C.

(57) ABSTRACT

The disclosure relates to a wood material board production installation for producing a wood material board, in particular a high density fiberboard, the installation having a wood material board workpiece production device for producing a wood material board workpiece and a digital printing device for printing the wood material board workpiece. A temperature measurement device is provided which is disposed to determine an entering temperature of the wood material board workpiece during printing.

11 Claims, 1 Drawing Sheet

(56) References Cited

U.S. PATENT DOCUMENTS

| | | | |
|---|---|---|---|
| 2010/0223881 | A1 | 9/2010 | Kalwa |
| 2013/0153153 | A1 | 6/2013 | Kalwa |

FOREIGN PATENT DOCUMENTS

| | | |
|---|---|---|
| EP | 1820640 | 8/2007 |
| EP | 2226201 | 9/2010 |
| EP | 2301762 | 3/2011 |

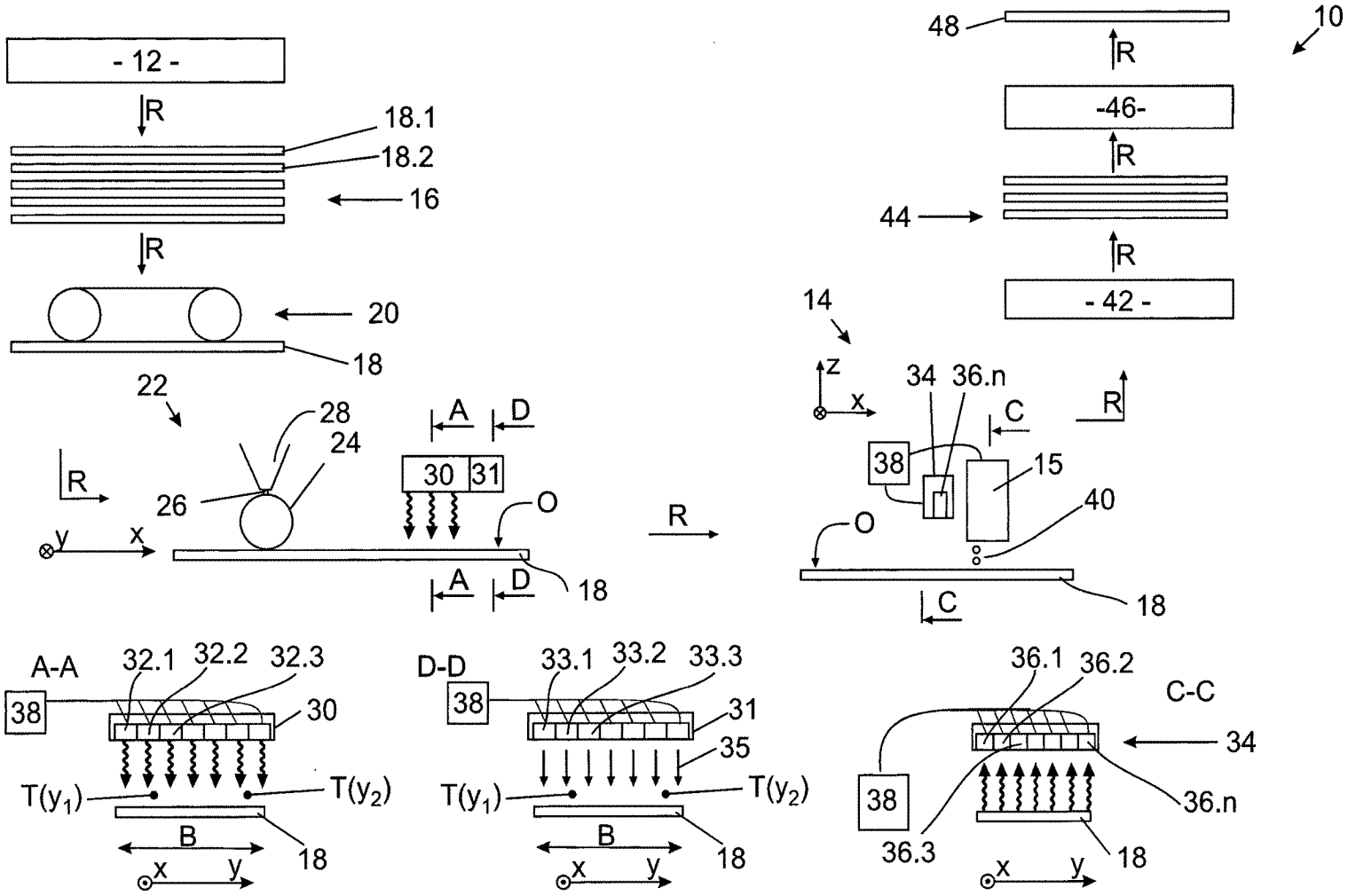
10
48
-46-
44
- 42 -
R
14
z
x
34
36.n
38
C
15
40
O
18
C-C
36.1
36.2
36.3
y
- 12 -
18.1
18.2
16
20
22
28
24
26
30
31
A
D
A-A
32.1
32.2
32.3
T(y1)
T(y2)
B
D-D
33.1
33.2
33.3
35

ENGINEERED WOOD BOARD PRODUCTION INSTALLATION AND METHOD FOR PRODUCING AN ENGINEERED WOOD BOARD

FIELD OF THE INVENTION

The invention relates to a wood material board production installation for producing a wood material board, in particular a high density fiberboard, said installation having (a) a wood material board workpiece production device for producing a wood material board workpiece and (b) a digital printing device for printing the wood material board workpiece. According to a second aspect, the invention relates to a method for producing a wood material board, in particular a high density fiberboard that includes the steps: (i) production of a wood material board workpiece and (ii) printing of the wood material board workpiece with a decoration.

DISCUSSION OF BACKGROUND INFORMATION

The surfaces of wood material boards, particularly high density fiberboards, features a coloring that can change from charge to charge, and even within a charge. This effect occurs particularly clearly upon a change in the wood formula used for producing the wood material board and/or in the condition of the thermomechanic pulping. Wood material board workpieces are therefore often primed before printing. The primer should ensure an even coloring from both board to board and charge to charge, such that the subsequent printing leads to a reproducible result. The wood material board workpieces are generally primed to be white. In order to achieve this, the wood material board workpiece is primed with several applications of white pigmented synthetic resins, such as melamine resin. Before the printing, the primer is dried in order to reduce the proportion of water in the synthetic resin.

However it has been proven that, despite the primer being applied under identical printer settings, different printing results are achieved on the wood material board workpiece over time; this is undesirable.

SUMMARY OF THE INVENTION

The invention aims to increase reproducibility when printing wood material board workpieces.

The invention solves the problem by means of a wood material board production installation according to the preamble that comprises a temperature measurement device that is disposed in order to determine an entering temperature of the wood material board workpiece during printing.

According to a second aspect, the invention solves the problem by means of a method according to the preamble during which an entering temperature of the wood material board is determined before printing and during which a temperature warning signal is generated if the entering temperature lies outside of a predetermined target interval.

The advantage of the invention is that the produced wood material boards have a low color variation. It has been proven that the temperature of the wood material board workpiece has a significant influence on the print result. At a higher temperature, the ink that is sprayed on during printing does not flow as far, as it loses water more rapidly due to the higher temperature. When the wood material board workpiece is at a higher temperature, the viscosity of the ink that is sprayed on increases more quickly and the ink droplets have a relatively small diameter. Conversely, when the wood material board workpiece is at a lower temperature, the viscosity of the ink droplets decreases more slowly, meaning that the ink droplets run much more than at otherwise identical settings.

The described effect causes the printed image to appear saturated at a higher entering temperature. A lower entering temperature results in a higher coverage, but the image of the printed motif is blurry. Both effects are undesirable. The temperature measurement device enables the monitoring of the entering temperature at which the wood material board workpiece enters the digital printing device. This means it is possible, on the basis of the determined temperature, to exert an influence on the entering temperature so that the entering temperature always remains in a target interval.

Alternatively or additionally, it is possible that the measured entering temperature is used to at least temporarily deactivate the digital printing device if the entering temperature lies outside of the target interval. This prevents a wood material board from being supplied with an unsatisfactory printed picture and renders it possible to print the wood material board workpiece in a later process. Both lead to less waste.

A further advantage is that the increase in the print quality can be achieved by technically simple means. The measurement of the temperature does not require complex equipment and can also be conducted with a high level of process reliability. Therefore, the advantage of the improved printing result requires only a low level of additional equipment complexity.

A further advantage is that more detailed and color saturated decorations can be printed. Thanks to the possibility of keeping the entering temperature in a target interval, the achievable level of detail needs no longer be considered during the design of the decoration, rendering it possible to print detailed decoration. The invention means that it is possible to print decorations that are even more realistic.

Within the scope of the present description, the digital printing device may be understood to mean a printing device by means of which the at least one liquid color can be dispensed on the wood material board workpiece in small droplets in such a way that an image is printed.

The temperature measurement device may be understood to mean a device by means of which a temperature can be determined at least on one surface of the wood material board workpiece that is clearly linked to the entering temperature. The entering temperature may be understood to mean the temperature of the wood material board workpiece when the digital printing device is printing on it. In other words, the entering temperature is the temperature of the surface of the wood material board workpiece directly below the print bar.

According to a preferred embodiment, the temperature measurement device is arranged on or in the digital printing device. Alternatively, the temperature measurement device is arranged such that, by means of the temperature measurement device, a temperature reading is obtained by means of which the entering temperature can be concluded with sufficient accuracy.

The temperature measurement device is preferably arranged in front of the digital printing device in a direction of material flow. However, it is also possible for the temperature measurement device to be arranged behind the digital printing device, with the temperature reading achieved in this way being generally of less informative value.

According to a preferred embodiment, the wood material board workpiece production device comprises a priming device for priming the wood material board workpiece, with the priming device comprising a dryer. The temperature measurement device is preferably connected to the dryer for the regulation of a drying temperature such that the entering temperature can be set by altering the drying temperature.

The priming device is preferably configured to prime the wood material board in white; for example, the priming device is designed to apply a pigmented, in particular a white pigmented, synthetic resin, in particular a melamine resin. Priming devices of this sort are known from the prior art and shall therefore not described any further.

Due to the fact that the priming device is arranged in front of the digital printing device in a direction of material flow, an increase in drying temperature generally leads to an increase in the entering temperature. It is therefore possible to regulate the entering temperature by altering the drying temperature. In order to keep the water proportion of the primer at a constant, even at varying temperatures, it is possible and represents a preferred embodiment that a parameter that influences the drying progress, such as an air velocity by means of which the warm air is blown across the primed wood material board workpiece, is automatically altered by a regulation or control of the dryer counter to the temperature, such that the entering temperature changes, but not the moisture in the primer.

According to a preferred embodiment, the wood material board production device comprises a control unit that is connected to the temperature measurement device and the digital printing device, and that it installed to generate a temperature warning signal if the entering temperature lies outside of a predetermined target interval and/or to automatically interrupt the printing if the entering temperature lies outside of the predetermined target interval. It is possible for the temperature warning signal to be converted into a signal that is detectable to humans. This allows a machine operator to influence the production conditions such that the entering temperature can be brought into the predetermined target interval. The result of interrupting the printing is that no wood material boards are produced, but it does allow the wood material board to be printed in a later process at the right temperature.

According to a preferred embodiment, the temperature measurement device comprises at least three temperature sensors placed at a distance from one another and it is installed to determine a temperature difference between at least two of the temperature sensors that are located at a distance from one another, and to generate a temperature difference warning signal if the temperature difference lies outside of a predetermined temperature interval. The temperature sensors are preferably arranged so that the temperature difference can be determined across a width of the wood material board workpiece. The width of the wood material board workpiece is the extension that runs perpendicular to the direction of material flow. Fundamentally, the aim should be for the wood material board workpiece to have as low a temperature gradient as possible across its entire width. If the temperature gradient and thus the temperature difference is too great, the print result varies across the width of the wood material board, which is undesirable.

According to a preferred embodiment, the temperature measurement device is installed to determine the temperature distribution across the width of the wood material board workpiece, and to determine a maximum temperature difference between two points along the width extension. Should the calculated temperature difference lie outside of a predetermined temperature difference interval, a warning signal is emitted, for example. Alternatively or additionally, a component of the wood material board production device that is arranged in front of the temperature measurement device in the direction of material flow is controlled is such a way that the maximum temperature difference is decreased. For example, the temperature measurement device comprises a thermo-camera.

According to a preferred embodiment, the dryer is designed to locally heat up the wood material board workpiece and to connect with the temperature measurement device such that the temperature difference can be reduced. For example, the dryer may be operated with warm air and comprise several outlet nozzles through out of which the warm air flows. If, for example, it is now detected that the right edge of the wood material board workpiece is too cold, the outlet over this edge can be opened wider so that more hot air reaches the wood material board workpiece, thereby heating it more intensively. This reduces the temperature difference. Alternatively or additionally, the temperature of the air may be altered.

In other words, it is especially beneficial if the temperature measurement device is designed to determine the distribution of the temperature across the width of the wood material board workpiece, wherein the dryer is connected to the temperature measurement device and is installed to heat up the wood material board workpiece such that the progress of the temperature deviates as little as possible from a target temperature progress. Generally speaking, the target temperature progress is an even temperature across the full width of the wood material board workpiece.

According to a preferred embodiment, the wood material board production installation comprises a temperature control unit that is designed to bring the wood material board workpiece to a predetermined entering temperature, at least on its surface, and/or to bring the wood material board workpiece to a predetermined entering temperature distribution, at least on its surface. This sort of temperature control unit means that undesired temperature deviations experienced by the wood material board workpiece after exiting the priming device can be offset, thereby keeping the entering temperature and/or the progress of the entering temperature at a constant in terms of time. The feature that the entering temperature remains at a constant in terms of time should be understood to mean a technical constant; that is to say that fluctuations in temperature are indeed unavoidable, but they do not leave a predetermined target interval.

The temperature control unit preferably comprises locally effective heat application elements by means of which at least the surface of the wood material board workpiece can be heated to a predetermined entering temperature. For example, the heat application elements are thermal radiation elements or warm air sources that emit warm air.

Alternatively or additionally, the temperature control unit comprises locally effective cooling elements by means of which at least the surface of the wood material board workpiece can be locally cooled to the predetermined entering temperature. For example, the cooling elements are cold gas elements that emit a cooling gas, in particular air.

The feature that a heat application element or cooling element is effective locally may be understood to mean that the wood material board workpiece can be heated or cooled by means of the heat application elements over a maximum width section of one third of its width such that a temperature change in this width section effected in this way is at least twice as large as a temperature change in an adjacent width section.

BRIEF DESCRIPTION OF THE DRAWINGS

In the following, the invention will be explained in more detail in the attached drawings. They show FIG. 1 a flow diagram of a wood material board production installation according to the invention.

DETAILED DESCRIPTION OF THE PRESENT INVENTION

FIG. 1 shows a schematic depiction of a wood material board production installation 10 which comprises a wood material board workpiece production device 12 and a digital printing device 14. A storage 16 is arranged behind the wood material board workpiece production device 12 in a direction of material flow R, the wood material board workpieces 18.1, 18.2, . . . being temporarily stored in said storage. A grinding installation 20 is arranged behind the storage 16 in the direction of material flow R, by means of which the wood material board workpieces 18 are smoothed on at least one side. This enables the creation of a reproducibly even surface.

A priming device 22 is arranged behind the grinding installation 20 in the direction of material flow R which, for example, comprises an application roller 24 by means of which a pigmented synthetic resin 26, which is supplied via a feed 28, is applied to the wood material board workpiece 18. A dryer 30 is arranged behind the application roller 24.

At the bottom of the partial picture, a cut along the line A-A is arranged. It should be recognized that the dryer 30 comprises a number of heating elements 32.1, 32.2, . . . that are arranged along a width extension B of the wood material board workpiece 18. The heat output and/or the temperature of each heating element 32 (any reference without a numerical suffix refers to all relevant objects) can be controlled individually so that a temperature T of the wood material board workpiece 18 can be altered on its surface O subject to a transverse coordinate y that runs along the width B.

A temperature control unit 31 may be arranged behind the dryer 30 in the direction of material flow which comprises locally effective cooling elements 33.1, 33.2, 33.3, . . . by means of which at least the surface O of the wood material board workpiece 18 can be cooled locally to a predetermined temperature T(y). This is shown in the partial picture by the cut D-D. For example, the cooling elements 33 are blowers for emitting a directed stream of cool gas made up of a cooling gas 35, such as air, onto the surface O. It is possible to use the surrounding air for this, which can mostly be used uncooled.

It is possible that the dryer 30 is not designed to set a local temperature. In this case, the temperature control unit 31 may comprise the heating elements 32 alongside the cooling elements 33. Of course it is possible that the temperature control unit 31 comprises only cooling elements or only heating elements.

The heating and/or cooling results in a temperature distribution T(y) that is selected in such a way that, at the location of a print head 15 of the digital printing device 14, a predetermined entering temperature $T_{14}$ or a predetermined entering temperature progress $T_{14}(y)$ occurs. How the temperature distribution T(y) should be set so that it results in the predetermined entering temperature progress $T_{14}(y)$ is identified in preliminary tests. In general, the aim for the entering temperature progress $T_{14}(y)$ should be to have as uniform a temperature as possible for all y positions.

The digital printing device 14 is arranged behind the dryer 30 in the direction of material flow R. A temperature measurement device 34 is located in front of the digital printing device 14 in the direction of material flow R. The temperature measurement device 34 comprises at least one temperature sensor 36; in the present case the temperature measurement device 34 has several temperature sensors 36.1, 36.2, . . . . The temperature sensors 36 are used to measure the temperature T with spatial resolution with regards to a width extension of the wood material board workpiece 18, as depicted schematically in the lower partial picture. The temperature sensors 36 preferably refer to infra-red sensors that work contactlessly, which detect the thermal radiation of the wood material board workpiece 18, schematically indicated by the arrows.

The wood material board production installation 10 comprises a control unit 38 that is connected to the temperature measurement device 34 and the digital printing device 14. The control unit 36 reads the temperature sensors 36.1, 36.2, . . . , **36.*n*, n being a natural number. The read temperatures $T(x_i)$ where i=1, 2, . . . , n are used to calculate an entering temperature $T_{14}$, for example by generating the arithmetic mean. If the temperature measurement device 34 only comprises one temperature sensor 36, the temperature T measured by this temperature sensor is equal to the entering temperature $T_{14}$ if the distance between the temperature measurement device 34 and the place where the wood material board workpiece 18** is printed is sufficiently small.

If the temperature T for one or several of the temperature sensors 36 lies below a predetermined target temperature $T_{Soll}$, the control unit 38, which is also connected to the dryer 30, drives the heating elements 32 in such a way that the temperature T of the wood material board workpiece 18 increases at least at the points where the temperature is too low. If the temperature measurement device 34 comprises only one temperature sensor or the temperature measurement device 34 comprises several temperature sensors that are not measured with spatial resolution, the dryer 30 may only have one heating element, such as a hot air blower.

The control unit 38 is also connected to the digital printing device 14. If the entering temperature $T_{14}$ lies outside of a predetermined target interval I=[Tmin, Tmax] with the predetermined minimum temperature $T_{min}$ and the predetermined maximum temperature $T_{max}$, the printing is interrupted, with the result that the application of ink 40 is interrupted and the wood material board workpiece 18 remains unprinted.

A drying device 42 is arranged behind the digital printing device 14 in the direction of material flow, by means of which the ink and the primer are dried. The resulting wood material boards are subsequently stored in a storage 44 and then coated with an abrasion protection layer in a coating installation 46, for example by means of the liquid overlay technique, resulting in a finished wood material board 48.

| Reference list | |
|---|---|
| 10 | wood material board production installation |
| 12 | wood material board workpiece production device |
| 14 | digital printing device |
| 15 | print head |
| 16 | storage |
| 18 | wood material board workpiece |
| 20 | grinding installation |
| 22 | priming device |
| 24 | application volumes |
| 26 | synthetic resin |
| 28 | feed |
| 30 | dryer |
| 31 | temperature control unit |

-continued

| Reference list | |
|---|---|
| 32 | heating element |
| 34 | temperature measurement device |
| 35 | cool gas |
| 36 | temperature sensor |
| 38 | control unit |
| 40 | ink |
| 42 | drying device |
| 44 | storage |
| 46 | coating installation |
| 48 | wood material board |
| B | width |
| I | target interval |
| n | natural number |
| R | direction of material flow |
| O | surface |
| T | temperature |
| $T_{14}$ | entering temperature |
| $T_{Soll}$ | target temperature |

The invention claimed is:

1. A wood material board production installation for producing a wood material board comprising:

(a) a wood material board workpiece production device for producing a wood material board workpiece, (b) a digital printing device for printing the wood material board workpiece, and (c) a temperature measurement device that is disposed to determine an entering temperature of the wood material board workpiece during printing, wherein:

the wood material board workpiece production device comprises a priming device for priming the wood material board workpiece, the priming device having a dryer, and the temperature measurement device is connected to the dryer for regulation of a drying temperature such that the entering temperature can be set by altering the drying temperature.

2. The wood material board production installation according to claim 1, further comprising a control unit: that is connected to the temperature measurement device and the digital printing device, and is installed to automatically generate a temperature warning signal if the entering temperature lies outside of a predetermined target interval and/or to automatically interrupt the printing if the entering temperature lies outside of a predetermined target interval.

3. A wood material board production installation for producing a wood material board comprising:

(a) a wood material board workpiece production device for producing a wood material board workpiece, (b) a digital printing device for printing the wood material board workpiece, and (c) a temperature measurement device that is disposed to determine an entering temperature of the wood material board workpiece during printing, wherein the temperature measurement device comprises at least three temperature sensors that are placed at a distance from one another, and is installed to determine a temperature difference and to generate a temperature difference warning signal if the temperature difference lies outside of a predetermined temperature difference interval.

4. A wood material board production installation for producing a wood material board comprising:

(a) a wood material board workpiece production device for producing a wood material board workpiece, (b) a digital printing device for printing the wood material board workpiece, and (c) a temperature measurement device that is disposed to determine an entering temperature of the wood material board workpiece during printing, wherein:

a dryer is designed to locally heat up the wood material board workpiece, and is connected to the temperature measurement device in such a way that the temperature difference can be reduced.

5. The wood material board production installation according to claim 1, further comprising a temperature control unit that is designed to bring the wood material board to a predetermined temperature and/or a predetermined temperature distribution, at least on its surface.

6. A wood material board production installation for producing a wood material board comprising:

(a) a wood material board workpiece production device for producing a wood material board workpiece, (b) a digital printing device for printing the wood material board workpiece, (c) a temperature measurement device that is disposed to determine an entering temperature of the wood material board workpiece during printing, and (d) a temperature control unit that is designed to bring the wood material board to a predetermined temperature and/or a predetermined temperature distribution, at least on its surface, wherein the temperature control unit comprises locally effective heating elements, by means of which at least the surface of the wood material board workpiece can be locally heated to a predetermined temperature.

7. A wood material board production installation for producing a wood material board comprising:

(a) a wood material board workpiece production device for producing a wood material board workpiece, (b) a digital printing device for printing the wood material board workpiece, (c) a temperature measurement device that is disposed to determine an entering temperature of the wood material board workpiece during printing, and (d) a temperature control unit that is designed to bring the wood material board to a predetermined temperature and/or a predetermined temperature distribution, at least on its surface, wherein the temperature control unit comprises locally effective cooling elements, by means of which at least the surface of the wood material board workpiece can be locally cooled to a predetermined temperature.

8. A method for producing a wood material board, in particular a high density fiberboard, comprising:

(i) production of a wood material board workpiece, (ii) printing of the wood material board workpiece with a decoration, (iii) determination of an entering temperature of the wood material board workpiece prior to printing, and (iv) generation of a temperature warning signal if the entering temperature lies outside of a predetermined target interval, wherein the printing is interrupted if the entering temperature lies outside of a predetermined target interval.

9. A method for producing a wood material board, in particular a high density fiberboard, comprising:

(i) production of a wood material board workpiece, (ii) printing of the wood material board workpiece with a decoration, (iii) determination of an entering temperature of the wood material board workpiece prior to printing, (iv) generation of a temperature warning signal if the entering temperature lies outside of a predetermined target interval, (v) priming of the wood material board workpiece before printing the wood material board workpiece, said priming comprising drying at a drying temperature, and (vi) regulation of the drying temperature so that the entering temperature lies in the target interval.

10. A method for producing a wood material board, in particular a high density fiberboard, comprising:

(i) production of a wood material board workpiece, (ii) printing of the wood material board workpiece with a decoration, (iii) determination of an entering temperature of the wood material board workpiece prior to printing, (iv) generation of a temperature warning signal if the entering temperature lies outside of a predetermined target interval, (v) determination of a temperature difference at locations placed at a distance from one another with regards to a transverse direction that runs perpendicular to a direction of material flow, and (vi) regulation of a local distribution of the drying temperature so that the temperature difference lies in a predetermined temperature difference interval.

11. The method according to one of the claim 8, further comprising:

tempering of the wood material board workpiece to an entering temperature, at least on its surface, which lies within the predetermined target interval if the entering temperature lies outside of the predetermined target interval.

* * * * *